United States Patent [19]

Böhme et al.

[11] Patent Number: 4,618,749

[45] Date of Patent: Oct. 21, 1986

[54] SOLID INSULATOR-TYPE VACUUM SWITCH GEAR

[75] Inventors: Klaus Böhme, Dresden; Wolfgang Beyer, Radebeul; Günter Seibt, Dresden; Michael Digmayer, Nossen, all of German Democratic Rep.

[73] Assignee: VEB Otto Buchwitz Starkstrom Anlagebau Dresden, Dresden, German Democratic Rep.

[21] Appl. No.: 777,225

[22] Filed: Sep. 18, 1985

[30] Foreign Application Priority Data

Sep. 24, 1984 [DD] German Democratic Rep. ... 267532

[51] Int. Cl.[4] ..... H01H 33/66

[52] U.S. Cl. ..... 200/144 B; 200/144 R

[58] Field of Search ..... 200/144 B, 144 R

[56] References Cited

U.S. PATENT DOCUMENTS 3,147,356 9/1964 Luehring ..... 200/144 B 4,568,804 2/1986 Luehring ..... 200/144 B

*Primary Examiner*—Robert S. Macon

*Attorney, Agent, or Firm*—Gabriel P. Katona

[57] ABSTRACT

A vacuum switching apparatus having a pair of terminal members extending from a housing made from a fully solid insulating material such as epoxy resin, and forming an outer housing for the vacuum switching apparatus, into which a vacuum switching chamber is placed housing a fixed and a movable contact member, the movable contact member extending through metallic bellows into a sliding contact and into the coupling terminal, wherein a pair of control electrodes each being conductively coupled to a different one of the terminal members is embedded into the fully solid insulating housing and lying at the potential of the respective terminal members, a further control electrode placed in the insulating housing and lying in a region so that it will assume an intermediate potential between the terminal potentials and the ground potential and wherein further a grounded outer metallic casing encloses insulating housing.

11 Claims, 3 Drawing Figures

SOLID INSULATOR-TYPE VACUUM SWITCH GEAR

FIELD AND BACKGROUND OF THE INVENTION

The present invention relates to a solid insulator-type vacuum switch gear having a pair of terminals and an insulator housing which is covered by an outer grounded cover and which in its inside comprises a vacuum switching chamber and, wherein between the switching chamber and the insulator housing gas is provided. Such vacuum switch gear having solid insulator housing are preferred for the ready-made type high voltage switching apparatus or transformer stations, wherein the requirements with respect to touch contact and with respect to space savings and compact structure are very high.

It is known to provide within the switch gear a vacuum switching chamber which comprises an evacuated housing therein along with metallic shields.

A fixed contact member is arranged on a fixed contact rod which is led out from the housing in a vacuum tight fashion through an insulator. A movable contact member is on the other hand arranged on a axially movable contact rod which is led out in a vacuum tight fashion from the housing through an insulator and metal bellows. Furthermore, there are provided metallic shields lying at a free potential between the insulators. Between the vacuum switching chamber and the insulator housing there is either air (German Pat. No. 23 22 372), or the intermediate chamber is filled with an insulating oil (Japanese Pat. No. 55-5651).

In the event in the intermediate chamber between the switching chamber and the insulator housing air is provided, then in spite of the field controlling structure of the coupling members on the electrically highly stressed paths, partial electrical discharge may take place, which is unavoidable.

Switch gear having oil in the intermediate chamber, possesses similar disadvantages as the so-called oil-less switch gear, since they are susceptible to fire hazard and represent also an endangerment for the environment. Furthermore, it became known to embed the entire vacuum switch chamber in epoxy resin (German Laid-Open Appln. No. 22 40 106). This construction, however, gives rise to disadvantages due to the fact that inner mechanical tensions effecting the vacuum switching chamber are unavoidable, and cracks as well as air gaps and air pockets may form which cannot be reliably prevented. In such defects then electrical partial discharges may take place which have the well known destructive consequences.

The above-described solid material and air insulated vacuum switch gear have in addition the further disadvantage that they cannot be touched while they are in operation and in order to satisfy the touch protection requirements, they must be built into metal encapsulated units, or provided with addtional enclosures. These disadvantages can be eliminated in a known manner, by the simultaneous reduction of the dimensions and applying the principle of solid material insulation acccording to which the entire current path and all components under high voltage are embedded in solid insulating material on the upper surface of which a grounded metallic shield is provided (Journal Elektrie 28 (1974) Volume 10, pages 533–538).

SUMMARY OF THE INVENTION

The present invention rests on the realization that in order to improve the above-noted disadvantages of the prior art vacuum switch gear, partial discharges between the switching chamber and the insulating material housing must be prevented by avoiding the creation of extremely high local field strengths and, that a protection against small spacings and touch contact can be accomplished by placing the electrically highly stressed regions into the solid insulating material itself.

It is, therefore, an object of the present invention to provide an improved vacuum switch gear in which although having its vacuum switching chamber arranged in an insulating material housing having a grounded cover, partial discharges are reliably prevented in the gas-filled chamber lying between the switching chamber and the insulating material housing.

The foregoing and other objects of the present invention will become apparent as the following description proceeds and features of novelty which characterize the invention will be pointed out in particularity in the claims affixed to and forming a part of this specification.

BRIEF DESCRIPTION OF THE DRAWINGS

The invention will become more readily apparent from the following description of a preferred embodiment thereof shown, by way of example, in the accompanying drawings, in which.

DESCRIPTION OF THE PREFERRED EMBODIMENTS

Figure 1:
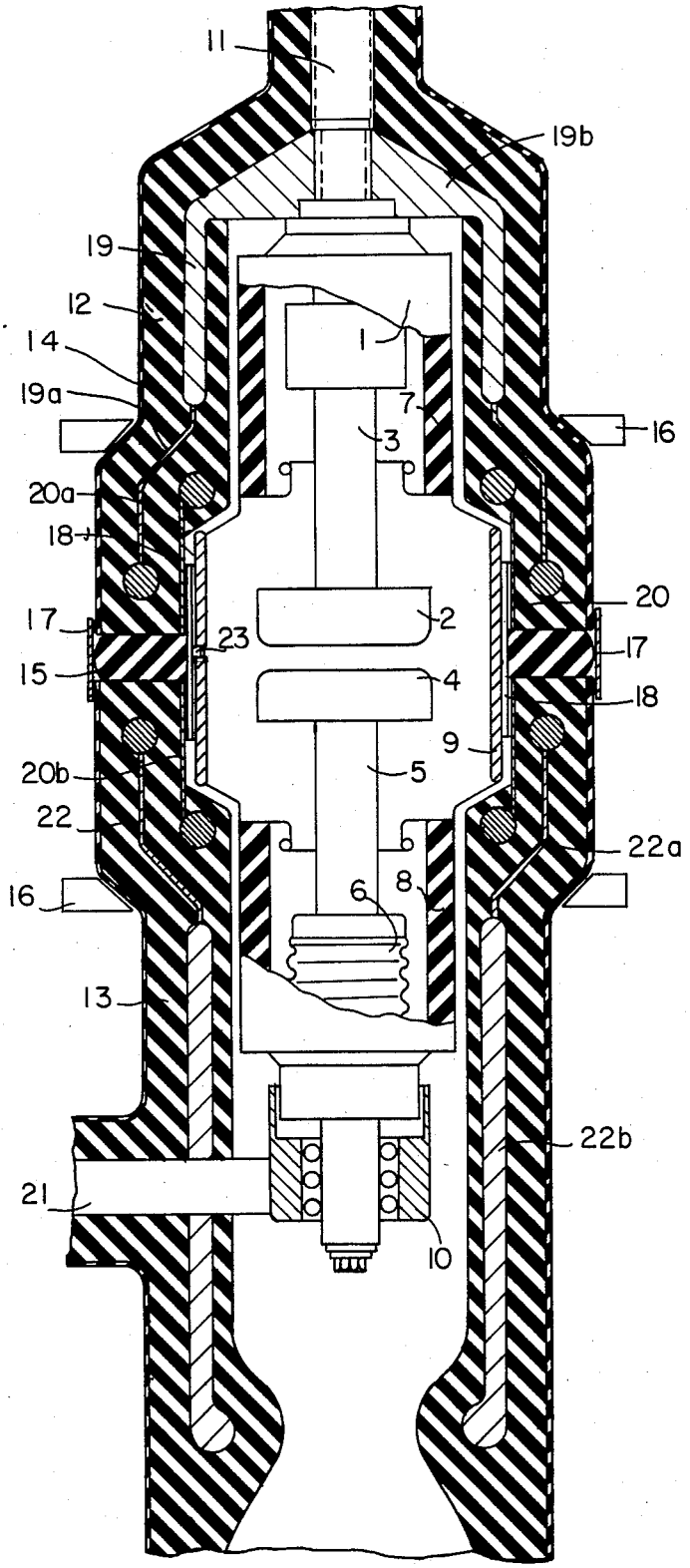
FIG. 1 illustrates in a schematic fashion and partly in section a vacuum switch gear according to the present invention having an insulating housing comprising two releasibly coupled members and in which the electrodes coupled to the terminal voltage have larger diameters in the overlap region than the third control electrode.

With reference to FIG. 1, illustrating schematically and partly in section a full vacuum switch gear 1 having an upper fixed contact member 2 fixedly connected to an upper stationary contact rod 3, and a lower movable contact member 4 mounted on a axially movable lower contact rod 5 and passing through a metallic bellows 6 to the outside, as hereinafter described. The contact members 2 and 4 with their respective contact rods 3 and 5 are mounted in an air-tight and evacuated housing which includes an upper insulator 7 and a lower insulator 8 as well as a metallic shield 9 lying at free potential.

The insulators 7 and 8, as well as the metallic shield 9 are preferably cylindrical in shape.

At the end of the vacuum chamber a sliding contact 10 is provided, particularly at one end thereof, while at the other end thereof a contact 11 is provided, which form the terminals of the vacuum switch gear.

The vacuum switch chamber 1 is mounted in an upper cylindrical insulating body 12 which is made from a fully solid insulating material and in a lower cylindrical insulating member 13 which is also made from a fully solid insulating material and which together form an insulating housing. The insulating members 12 and 13 which on their outer upper surface are provided with a metallic cover 14 lying at ground potential, are dielectrically tightly coupled through an elastic insulating ring 15 and by means of tensioning elements 16, and wherein the side-wise displacement of the elastic insulating ring 15 is prevented by an inner and an outer metallic limiting ring 17 and 18. In the upper insulating member 12 made from a fully solid insulating material an upper control electrode 19 having the same potential as the upper contacts 11, as well as a third control electrode 20 lying at the free intermediate potential of the metallic shield 9 of the vacuum switch chamber 1 are embedded in such a fashion that the control electrode 19 lies between the grounded metal cover 14 and the control electrode 20. The upper control electrode 19 may simultaneously serve for the mechanical securing of the vacuum switch chamber onto the upper fixed contact rod 3, such as by threaded coupling. The upper contact rod 3 protrudes through the upper insulating member 12 made from the solid insulating material and forms the upper terminal. The control electrode 19 is manufactured preferably from a rotation-symmetrical sheet metal body 19*a* and from a thick-walled cup-shaped base member 19*b* which construction provides a favorable waste heat conduction from the vacuum switch chamber 1 in the upper insulating member 12 made from the fully solid insulating material and from which the heat transfer will take place into the surrounding air space. In the lower insulating member 13 made from the fully solid insulating material the lower control electrode 22 lying at the potential of the lower terminal, the latter including the lower contact rod 5, the sliding contact 10 and the terminal stub 21 on the switch gear, as well as the third control electrode 20 lying at the free intermediate potential of the metallic shield 9 are embedded in such a manner, that the control electrode 22 is lying in the space between the grounded metallic cover 14 and the control electrode 20. The axially movable lower contact rod 5 to which an appropriated drive is connected, protrudes into the sliding contact 10, which in turn is coupled with the contact terminal stub 21 of the switch gear and embedded in the lower insulating member made from the fully solid insulating material. The sliding contact 10 is constructed in such a manner to assure the vacuum switch gear 1 a certain radial displacement by having an appropriate shaping. The control electrode 22 is again manufactured suitably from a rotation-symmetrical sheet metal body 22*a* and from a thick-walled annular base member 22*b*, whereby a favorable waste heat conduction is assured from the vacuum switch chamber 1 and from the sliding contact 10 into the lower insulating member 13 made from the fully solid insulating material from which the heat is transferred into the surrounding air space.

The lower and upper parts 20 and 20*b* of the third control electrode 20 lying at the free intermediate potential of the metallic shield 9 are coupled with each other electrically by means of an inner limiting ring 18 and are connected by means of an appropriate contact element 23, such as by a spring, to the metallic shield 9 of the vacuum switch chamber 1. In some situations one may omit such contact element 23, when by means of capacitive potential splitting within the insulating members 12 and 13 of fully solid insulating material and in the vacuum switch chamber 1 substantially the same intermediate potentials exists for the control electrode 20 on one hand, and for the metallic shield 9 on the other hand.

Figure 2:
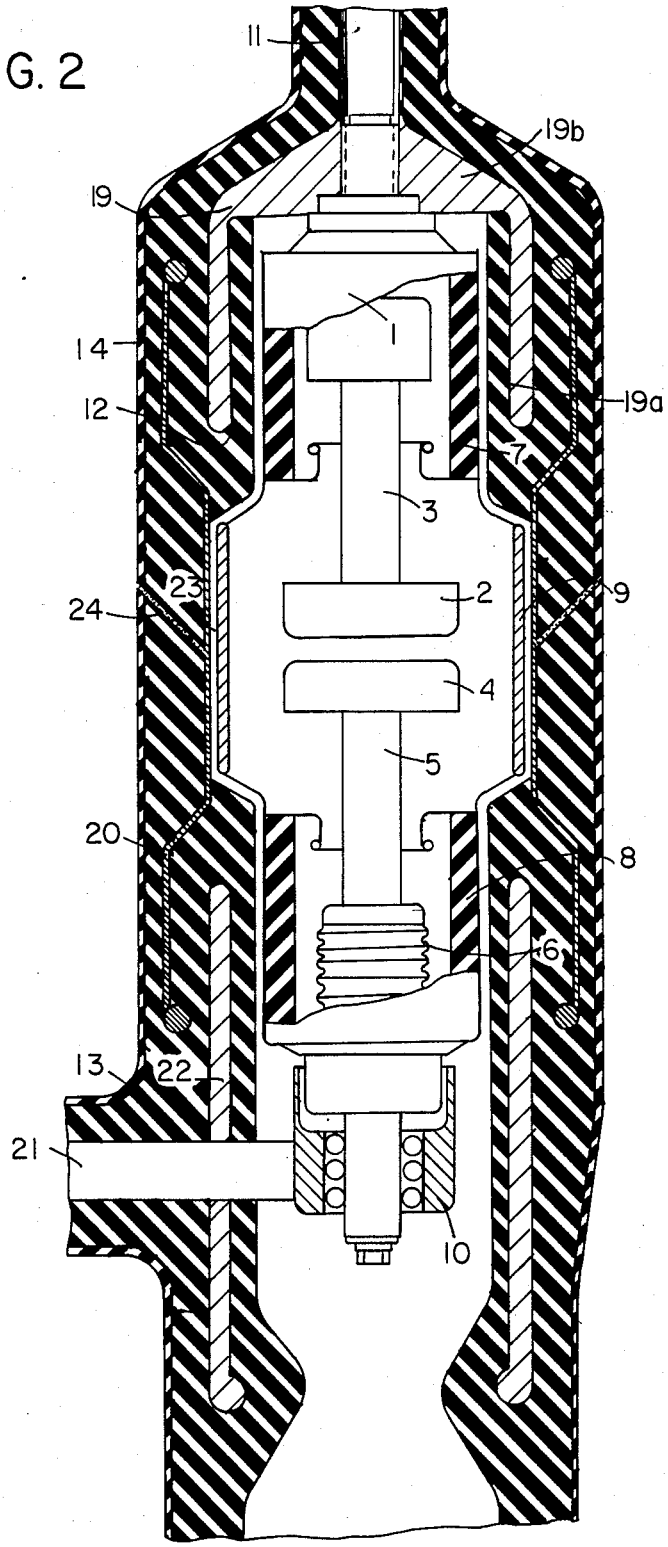
FIG. 2 illustrates another embodiment of the vacuum switch gear according to the present invention having an insulating housing the portions of which are coupled together by means of adhesive material and in which the electrodes coupled to the terminal voltage in their overlapping region possess larger diameters then the third control electrode.

With reference to FIG. 2 in which like elements will be identified by the same reference characters as in FIG. 1, it is noted that the third control electrode 20 lying on the free intermediate potential assumes a different position due to the structural differences noted in the Brief Description of the Drawings. The entire vacuum switch chamber is constructed similarly as in FIG. 1, namely it comprises a lower and an upper insulating members 12 and 13 made from a fully insulating material and which is coupled with the sliding contact 10 and the control electrodes 19 and 22.

Both insulating members 12 and 13 are coupled together in the embodiment of FIG. 2 by means of an adhesive material 24. They can, however, within the scope of the invention, also be coupled for an improved exchanging of the vacuum switch chamber 1, by the provision of a dielectrical coupling of the insulating members 12 and 13, similarly as in FIG. 1, by means of an elastic insulating ring 15, tensioning element 16 as well as by the limiting rings 17 and 18. The essential difference between the vacuum switching gear of FIG. 2 with respect to that of FIG. 1 resides in the different positioning of the control electrodes 19 and 22 with respect to the potential of the contact terminals as far as the control electrode 20 is concerned and with respect to the intermediate potential of the metallic shield 9. The control electrodes 19 and 22 having the potential of the switch gear terminals as well as the control electrode 20 having the free intermediate potential of the metallic shield 9, are embedded in the insulating members 12 and 13 made from the fully insulating material in such a manner that the control electrode 20 is lying in the space between the grounded metallic cover 14 and the control electrodes 19 and 22. The control electrodes 19 and 20 suffice if made only from the thick-walled cup-shaped base member 19*b* and from the annular-shaped base member 19*a*, respectively. By arranging the control electrode 20 according to the present invention at a free intermediate potential of the metallic shield 9 within the insulating members 12 and 13 and in addition with respect to the control electrodes 19 and 22 having the potential of the switching gear terminals, will be accomplished, that the voltage division within the vacuum switch chamber 1 as well as its switching capacity in the operational state will not be disturbed by the grounded metallic cover 14 and, the electrical field strength in the air space between the vacuum switch chamber 1 and the insulating members 12 and 13 made from the fully solid insulating material will be reduced to such an extent that no damaging electrical partial discharges can take place in the air at operating potential.

Figure 3:
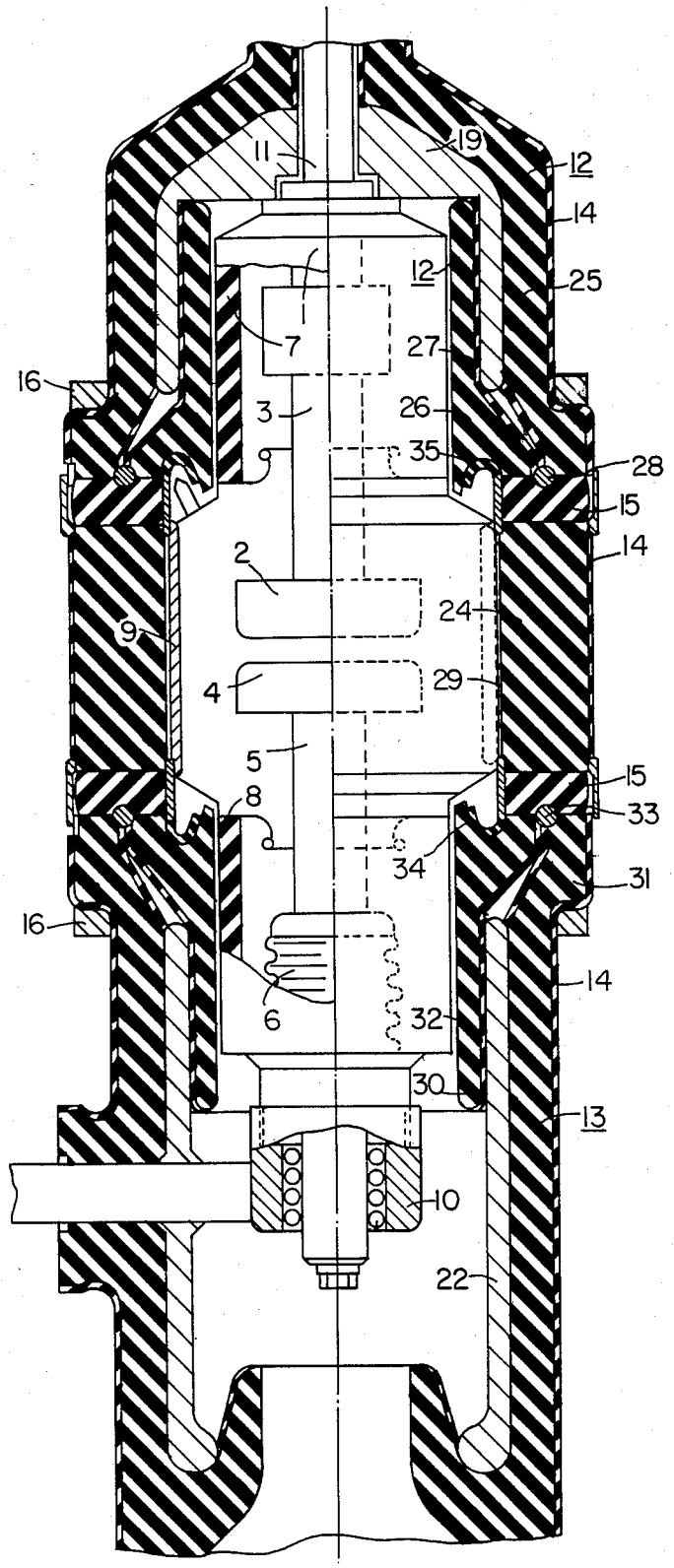
FIG. 3 illustrates schematically and partly in section a still further embodiment of the vacuum switch gear according to the present invention having an insulating housing which comprises three releasibly coupled parts in which the electrodes coupled to the terminal voltage comprise at least partially inserts which are arranged on insulating material members coaxially coupled together but forming separately made components.

With reference to FIG. 3, it is seen that the switch gear in this third embodiment is provided with an insulating housing which comprises an upper cylindrical insulating member 12 made from fully solid insulating material, an intermediate or middle cylindrical insulating member 24 made also from a fully solid insulating material, as well as a lower insulating member 13 also made from a fully solid insulating material. The insulating members 12, 13 and 24 which are provided on their outer surface with a grounded metallic cover 14 are coupled with each other in a dielectrically tight fashion by means of elastic insulating rings 15 and tensioning elements 16. The upper insulating member 12 includes a pair of individual elements 25 and 26 made from an epoxy resin which by being provided with semi-conductor or conductive inserts or covers on at least a portion of their upper surface will form a part of the control electrode 27 which at one of its ends is closed by an electrode ring 28, while at its other end abutts on to the control electrode 19 which lies at the potential of the switch gear terminals. The control electrode 19 comprises preferably a rotation-symmetrical thick-walled cup-shaped base member, in order to provide for a favorable waste heat conduction from the vacuum switch chamber 1 into the upper insulating member 12 made from the fully solid insulating material, from which the heat transfer occurs into the surrounding air. The middle or intermediate insulating member 24 carries on its inner circumference a substantial portion of a control electrode 29. The lower insulating member 13 comprises also a pair of individual components 30 and 31, each having semiconductive or conductive covers on at least a portion of their upper surface wi11 form a part of the control electrode 22 which itself is closed by an electrode ring 33 and wherein the control electrode 22 also lies on the switch gear terminal potential. The third control electrode 29 comprises essentially the cover on the middle or intermediate insulating member 24 as well as a smaller cover surface 34 and 35 provided on the individual members 30 and 26. The covers of the third control electrode 29 are coupled with each other as well as with the metallic shield 9.

In the vacuum switch gear according to the present invention dangerous partial discharges in the region between the vacuum switch chamber and the insulating housing as well as within the insulating housing are reliably prevented, due to the fact that no local extremely high field strength could take place. Further advantages reside in the relatively simple manufacturing of the components of the insulating housing.

We wish it to be understood that we do not desire to be limited to the exact details of construction shown and described, for obvious modifications will occur to a person skilled in the art.

Having thus described the invention, what we claim as new and desire to be secured by Letters Patent, is as follows:

1. A vacuum switching apparatus comprising a housing made from an insulating material, a cover means on the outer surface of said housing, said cover means adapted to be connected to ground potential, a vacuum switching chamber placed into said housing, a fixed and a movable contact member mounted in said vacuum switching chamber and each extending through said housing and forming a terminal means, said insulating housing and said vacuum switching chamber forming a space therebetween, gas filling said space, a pair of control electrodes embedded in said insulating housing axially spaced from each other, each of said pair of control electrodes being conductively coupled to a different one of said terminal means, and a further electrode means spaced from said pair of electrode means between said insulating housing and in a region of said insulating housing located with respect to said switching chamber in such a manner that said further electrode is at an electric potential lying between the potential of said terminal means and said ground potential.

2. The vacuum switching apparatus according to claim 1, wherein said pair of electrodes extend axially between said insulating housing with a spacing therebetween and overlapping in the axial direction with said further electrode.

3. The vacuum switching apparatus as claimed in claim 1, wherein said insulating housing, said vacuum switching chamber, said pair of electrodes and said further electrode are formed as hollow rotational bodies.

4. The vacuum switching apparatus according to claim 3, wherein said hollow rotational bodies are hollow cylindrical in shape.

5. The vacuum switching apparatus as claimed in claim 1, wherein said insulating housing comprises an upper and a lower member made from a fully solid insulating material, each of said terminal means being placed in a respective one of said upper and lower members, means for elastically and air-tight joining said upper and lower insulating members, one of said pair of control electrodes being placed in said upper insulating member and the other of said pair of control electrodes being placed in the lower one of said insulating housing members, said control electrode in said upper insulating member comprising a cup-shaped base member coupled to said terminal means and an elongated narrow metallic annular member extending from said cup-shaped member and terminating in an annular electrode ring for eliminating corona stresses in said insulating member, the other of said pair of control electrodes placed in the lower one of said insulating housing member being formed as a hollow cylindrical body of heavier construction and extending toward the other of said control electrode and forming a lighter annular electrode structure terminating in an electrode ring.

6. The vacuum switching apparatus as claimed in claim 1, wherein said movable contact member is coupled to a sliding contact means and to a drive means for operating said movable contact means, a bellows means surrounding said movable contact member and forming means for extending a contact rod of said movable contact member through an end portion of said vacuum switching chamber towards said slider contact means.

7. The vacuum switching apparatus as claim in claim 1, wherein said further electrode means comprises a hollow cylindrical member terminating at both ends thereof in a electrode ring for preventing corona stresses within said insulating housing member.

8. The vacuum switching apparatus as claimed in claim 1, wherein said vacuum switching chamber comprises an upper and a lower cylindrical insulating member and a metallic shield cylinder therebetween, said shield cylinder lying at a free potential, said further electrode being in conductive relationship with said shield cylinder.

9. The vacuum switching apparatus as claimed in claim 1 wherein said upper and lower insulating members form said housing, means for securely holding said upper and lower housing members together in an air-tight relationship.

10. A vaccum switching apparatus as claimed in claim 1, wherein said housing made from said fully insulated material comprises three housing members, an upper, an intermediate and a lower housing member, means for elastically joining said housing members, said further electrode being formed as a hollow cylindrical body on the inside surface of said intermediate housing member and extending into said upper and lower housing members in an overlapping relationship with said pair of control electrodes.

11. The vacuum switching apparatus as claimed in claim 1, wherein said insulating housing is made from a solid epoxy resin material embedding said pair of control electrodes and said further control electrode.

* * * * *